US008243965B2

(12) United States Patent
Lee

(10) Patent No.: US 8,243,965 B2
(45) Date of Patent: Aug. 14, 2012

(54) ELECTRO-ACOUSTIC TRANSDUCER

(75) Inventor: Fang-Ching Lee, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 742 days.

(21) Appl. No.: 12/422,484

(22) Filed: Apr. 13, 2009

(65) Prior Publication Data

US 2010/0092012 A1 Apr. 15, 2010

(30) Foreign Application Priority Data

Oct. 15, 2008 (TW) ..... 97139491 A

(51) Int. Cl.
*H04R 25/00* (2006.01)

(52) U.S. Cl. ..... 381/191

(58) Field of Classification Search ..... 381/191
See application file for complete search history.

(56) References Cited

U.S. PATENT DOCUMENTS

| | | | | |
|---|---|---|---|---|
| 1,759,810 | A | 5/1930 | Edelman | |
| 1,767,657 | A | 6/1930 | Edelman | |
| 2,896,025 | A | 7/1959 | Janszen | |
| 4,160,881 | A * | 7/1979 | Smulders | 310/357 |
| 2007/0195976 | A1 | 8/2007 | Sekino et al. | |
| 2010/0092013 | A1* | 4/2010 | Lee | 381/191 |

FOREIGN PATENT DOCUMENTS

| | | | |
|---|---|---|---|
| CN | 101203066 | A | 6/2008 |
| EP | 2150075 | A2 | 2/2010 |
| EP | 2182737 | A1 | 5/2010 |
| GB | 1 262 505 | A | 2/1972 |
| TW | I293233 | B | 2/2008 |

* cited by examiner

*Primary Examiner* — Charles Garber
*Assistant Examiner* — Reema Patel
(74) *Attorney, Agent, or Firm* — Birch, Stewart, Kolasch & Birch, LLP

(57) ABSTRACT

An electro-acoustic transducer is disclosed. The electro-acoustic transducer includes an electret diaphragm, an orifice plate and a plurality of dividing structures. The dividing structures, disposed between the electret diaphragm and the orifice plate, are cross-shaped. Each of the dividing structures includes two extending portions intersecting with each other.

13 Claims, 5 Drawing Sheets

ELECTRO-ACOUSTIC TRANSDUCER

This Application claims priority of Taiwan Patent Application No. 097139491, filed on Oct. 15, 2008, the entirety of which is incorporated by reference herein.

BACKGROUND OF THE INVENTION

1. Field of the Invention

The invention relates to an electro-acoustic transducer, and more particularly, to an electro-acoustic transducer characterized by an increased volume output and extension of low frequencies.

2. Description of the Related Art

A dividing material of an electro-acoustic transducer is utilized to separate an electret diaphragm and an orifice plate thereof in order to maintain a vibrating space therebetween. When charged with electricity, the electret diaphragm is able to vibrate according to an input signal.

FIG. 1 is a schematic view of a conventional electronic device. In a conventional electro-acoustic transducer 10, the dividing material 13, usually in a plaid shape, is protruded on the orifice plate 11. When the electret diaphragm 12 is disposed on the orifice plate 11, the electret diaphragm 12 contacts the plaid dividing material 13 to form rectangular spaces P therebetween for vibration. However, the rectangular spaces P are framed by four solid walls, limiting vibration of the electret diaphragm 12. In other words, the vibrating space required by the electret diaphragm 12 is limited by the dividing material 13, resulting in a decreased volume output and limited extension of low frequencies.

BRIEF SUMMARY OF THE INVENTION

The invention discloses an electro-acoustic transducer. The electro-acoustic transducer includes an electret diaphragm, an orifice plate and a plurality of dividing structures. The dividing structures, disposed between the electret diaphragm and the orifice plate, are cross-shaped. Each of the dividing structure includes two extending portions intersecting with each other.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
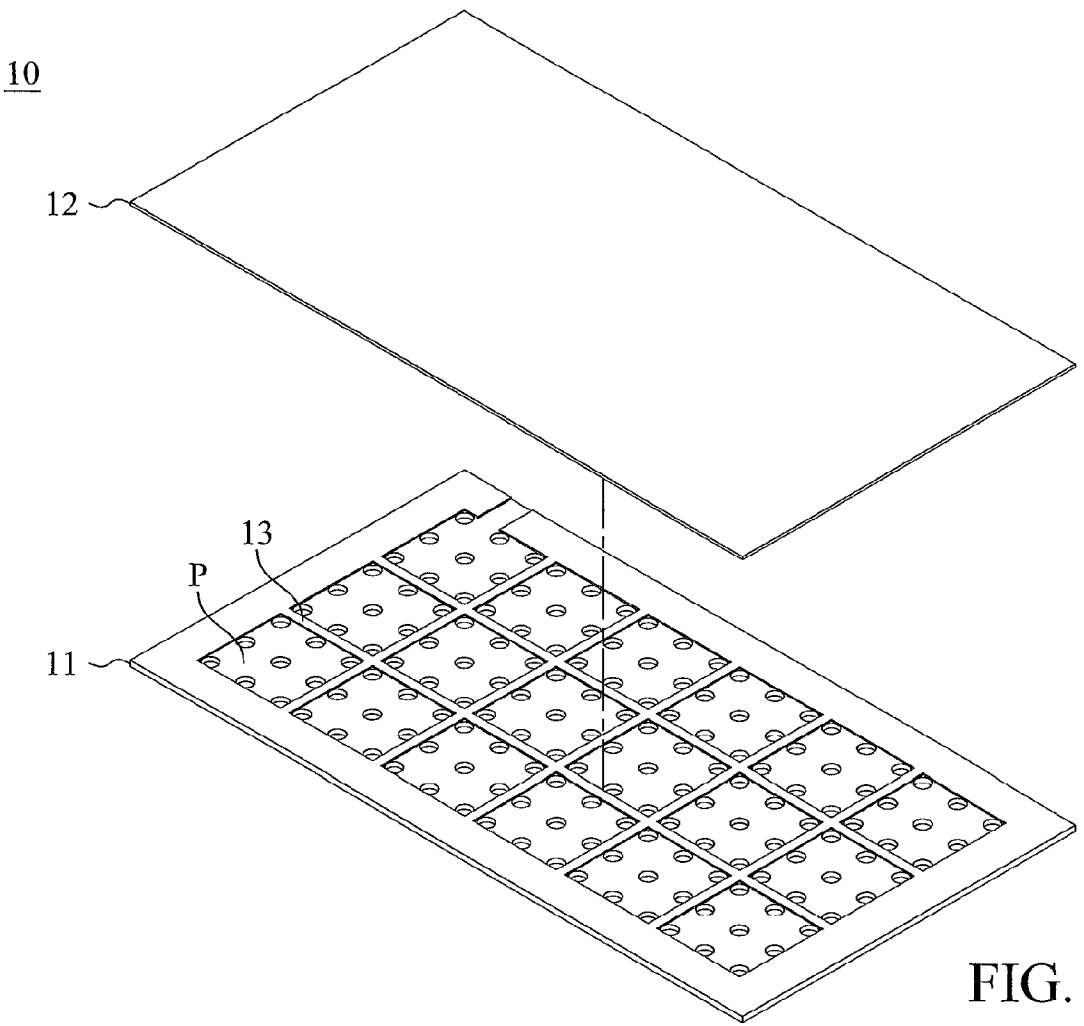
FIG. 1 ( PRIOR ART )
FIG. 1 is a schematic view of a conventional electronic device.
Figure 2:
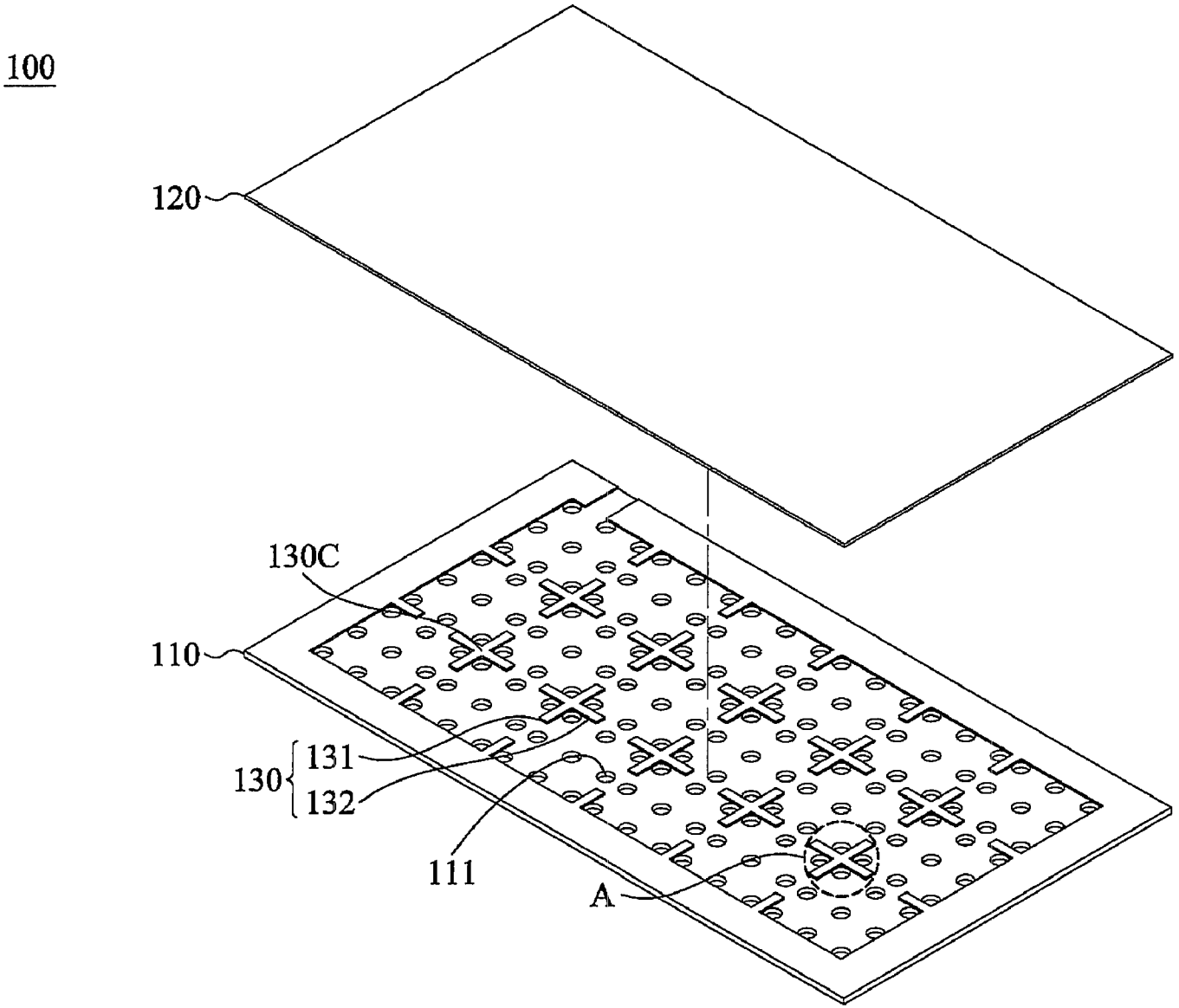
FIG. 2 is a schematic view of an electronic device of the invention.
Figure 3:
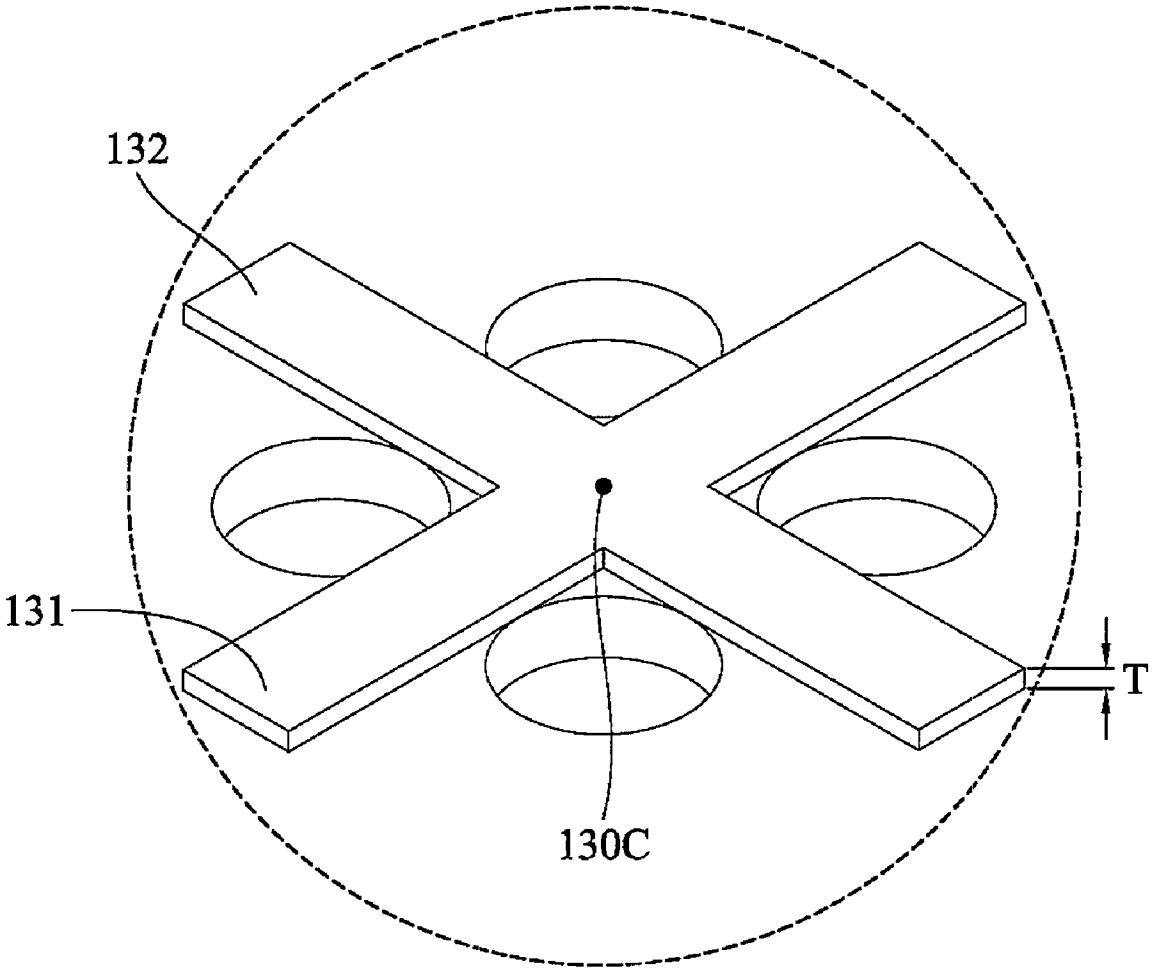
FIG. 3 is an enlarged view of portion A in FIG. 2.
Figure 4:
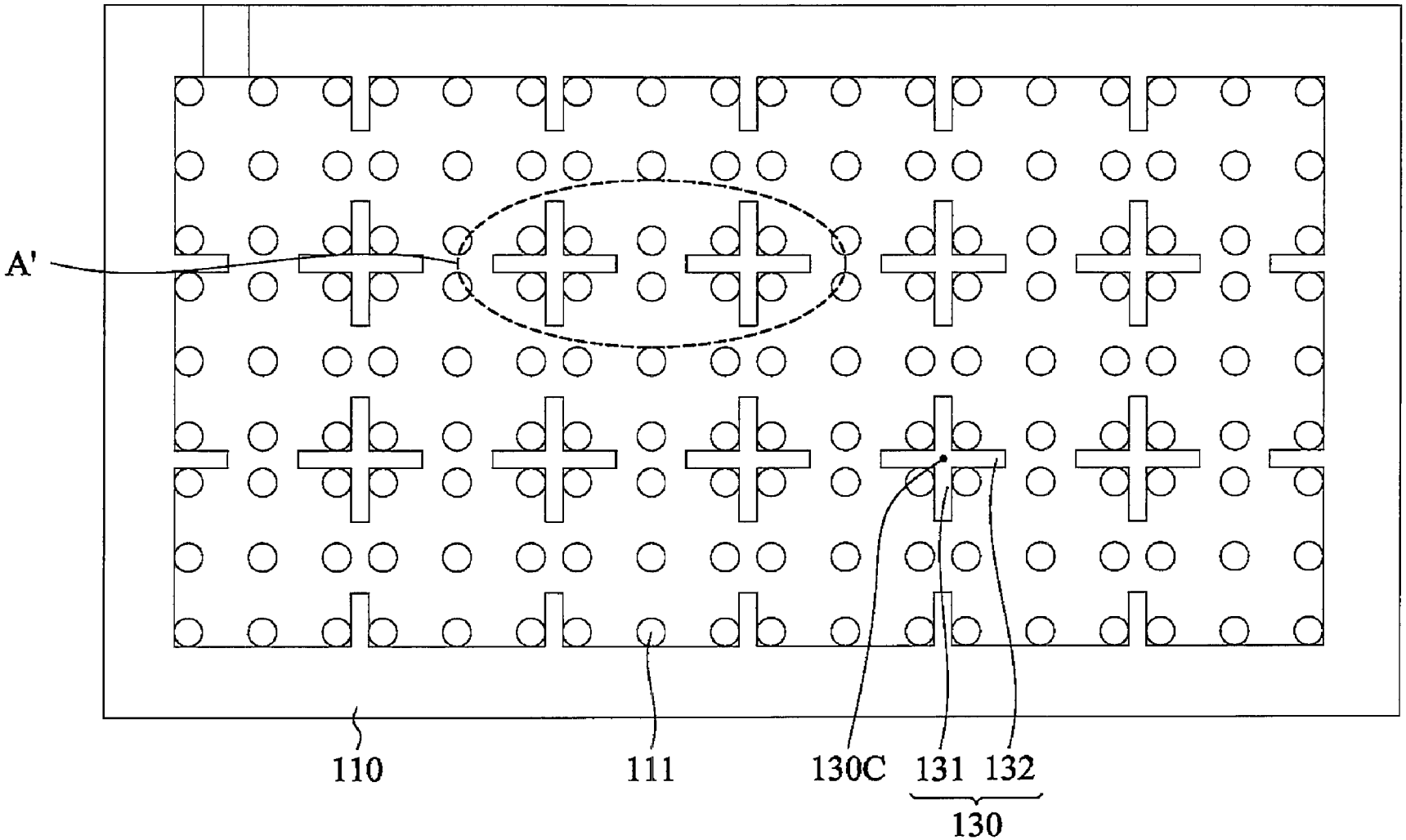
FIG. 4 is a top view of the electronic device of the invention.

FIG. 2 is a schematic view of an electronic device of the invention; FIG. 3 is an enlarged view of portion A in FIG. 2; FIG. 4 is a top view of the electronic device of the invention; and FIG. 5 is an enlarged view of portion A' in FIG. 4.

Referring to FIGS. 2 and 4, the electro-acoustic transducer 100 of the embodiment comprises an orifice plate 110, an electret diaphragm 120 and a plurality of dividing structures 130. The orifice plate 10 comprises a plurality of orifices 111, and the orifices 111 occupy 5~40% of the orifice plate 110, wherein the orifices 111 are circular-shaped or other shapes. The electret diaphragm 120 and the orifice 110 are separated by the dividing structures 130. It should be noted that dividing structures 130 are disposed on the orifice plate 110 or it can be formed integrally with the orifice plate 110. Additionally, the dividing structures 130 are arranged in a matrix (as shown in FIG. 4).

Figure 5:
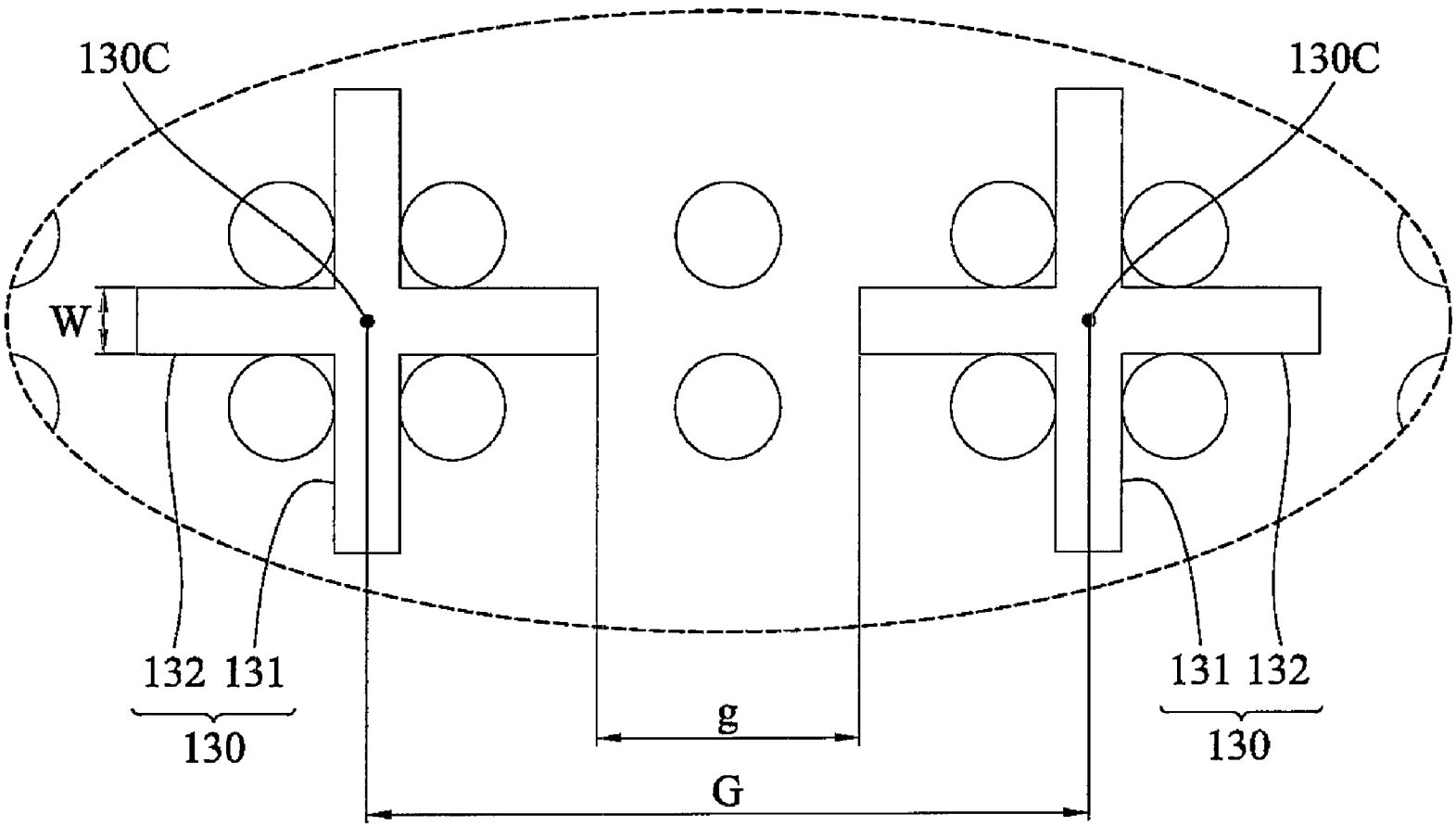
FIG. 5 is an enlarged view of portion A' in FIG. 4.

Referring to FIGS. 3 and 5, the dividing structures 130, which are cross-shaped, comprise two extending portions 131, 132. The extending portions 131, 132 are perpendicular to each other and intersect with each other at a center 130C. A first distance G is formed between the centers 130C of the two adjacent dividing structures 130. A second distance g is formed between the extending portions 131 or the extending portions 132 of the two adjacent dividing structures 130. The ratio of the first distance G to the second distance g is 5:2 or 5:3. For example, when the first distance G is 10 mm, the second distance g is 4 mm or 6 mm; when the first distance G is 15 mm, the second distance g is 6 mm or 9 mm. Meanwhile, the first distance G is preferably between 5 mm to 50 mm.

In addition, the extending portions 131, 132 respectively have a width W (as shown in FIG. 5) and a thickness T (as shown in FIG. 3). The width W of the extending portions 131, 132 is 1 mm, and the thickness T is derived from a formula: $T(\mu m)=(10\times G(mm)+100)\pm 20\%$. In other words, when the first distance G is 10 mm, the thickness T of the extending portions 131, 132 is 200 μm±20%; when the first distance G is 7 mm, the thickness T of the extending portions 131, 132 is 170 μm±20%; and when the first distance G is 15 mm, thickness T of the extending portions 131, 132 is 250 μm±20%.

In a real measurement, if the size and distance (1 mm) between two dividing structures (dividing materials) are the same, the volume output of the electro-acoustic transducer of the embodiment would be increased by 6 dB compared with the conventional electro-acoustic transducer.

Because the dividing structures of the electro-acoustic transducer of the embodiment are cross-shaped, the contact area between the electret diaphragm and the dividing structures is reduced, thereby increasing an effective vibrating area. Moreover, the sensitivity of the electret diaphragm is increased by 40%, and the low frequency is further extended.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electro-acoustic transducer, comprising:

an electret diaphragm;

an orifice plate comprising a plurality of orifices; and a plurality of dividing structures spaced apart from each other, wherein the dividing structures are cross-shaped and are disposed between the electret diaphragm and the orifice plate.

2. The electro-acoustic transducer as claimed in claim 1, wherein the dividing structures are disposed on the orifice plate, or are formed integrally with the orifice plate.

3. The electro-acoustic transducer as claimed in claim 1, wherein the dividing structures are arranged in a matrix.

4. The electro-acoustic transducer as claimed in claim 1, wherein each of the dividing structures has a center, and a first distance is formed between two of the centers of the dividing structures.

5. The electro-acoustic transducer as claimed in claim 4, wherein the first distance is substantially 10 mm.

6. The electro-acoustic transducer as claimed in claim 4, wherein the first distance is between 5 mm to 50 mm.

7. The electro-acoustic transducer as claimed in claim 4, wherein each of the dividing structures has a thickness derived from a formula: $T(\mu m)=(10\times G(mm)+100)\pm 20\%$, wherein T represents the thickness and G represents the first distance.

8. The electro-acoustic transducer as claimed in claim 4, wherein each of the dividing structures comprises two extending portions intersecting with each other at the center.

9. The electro-acoustic transducer as claimed in claim 8, wherein a second distance is formed between the extending portions of the two adjacent dividing structures, and the ratio of the first distance to the second distance is 5:2.

10. The electro-acoustic transducer as claimed in claim 8, wherein a second distance is formed between the extending portions of the two adjacent dividing structures, and the ratio of the first distance to the second distance is 5:3.

11. The electro-acoustic transducer as claimed in claim 8, wherein each of the extending portions has a width of 1 mm.

12. The electro-acoustic transducer as claimed in claim 1, wherein the orifices occupy 40% of the orifice plate.

13. The electro-acoustic transducer as claimed in claim 1, wherein the orifices are circular-shaped or other shapes.

* * * * *